United States Patent [19]

Dokoupil et al.

[11] 4,124,912

[45] Nov. 14, 1978

[54] APPARATUS FOR AUTOMATIC ADJUSTMENT OF THE POSITION OF WORKING MECHANISMS OF SHOE WORKING DEVICES

[75] Inventors: Ludvik Dokoupil; Oldrich Hrouda, both of Gottwaldov; Josef Zila, Travniky, all of Czechoslovakia

[73] Assignee: Zavody presneho strojirenstvi, Gottwaldov, narodni podnik, Gottwaldov, Czechoslovakia

[21] Appl. No.: 815,433

[22] Filed: Jul. 13, 1977

[30] Foreign Application Priority Data

Jul. 14, 1976 [CS] Czechoslovakia ..... 4658/76

[51] Int. Cl.[2] ..... A43D 3/00

[52] U.S. Cl. ..... 12/126

[58] Field of Search ..... 12/126, 127, 1 A

[56] References Cited

U.S. PATENT DOCUMENTS

| | | | |
|---|---|---|---|
| 2,975,443 | 3/1961 | Makovski | 12/126 |
| 4,000,535 | 1/1977 | Barton | 12/126 |

*Primary Examiner*—Patrick D. Lawson

[57] ABSTRACT

Working devices of shoe manufacturing machines are adjusted according to the size of the shoe and also whether a right or left shoe is concerned by first identifying these items and by transmitting this information to a device which automatically adjusts the working devices to the proper position.

5 Claims, 6 Drawing Figures

APPARATUS FOR AUTOMATIC ADJUSTMENT OF THE POSITION OF WORKING MECHANISMS OF SHOE WORKING DEVICES

BACKGROUND OF THE INVENTION

This invention relates to an apparatus for the automatic adjustment of the position of working devices of shoe manufacturing machines, particularly the devices of a stretching mechanism for shoe heels and shanks which are adjusted to conform to shoe size numbers and whether right or left shoe lasts are being treated. The apparatus is particularly adapted for use with a shoe manufacturing line with a conveyor. The lasts are provided with coding recesses in accordance with which the apparatus comprising such mechanically controlled devices is adjusted. The adjustment according to size numbers of lasts has heretofore been mostly accomplished independently, by mechanism controlled by attendants of the machine. In line production in modern highly efficient manufacturing plants this adjustment requires a halt in production and also requires a high concentration on the part of the attendant, and thereby induces substantial fatigue, thus influencing unfavorably the quality and safety of the work.

SUMMARY OF THE INVENTION

It is an object of this invention to provide an apparatus for the automatic adjustment of working devices of shoe stretching mechanisms according to (a) shoe size numbers and (b) whether the last is for a right or a left shoe. The lasts are provided with a strap piece or plate or with a bolt and with identification recesses.

According to the apparatus of the invention for the adjustment of the position of working devices of shoe stretching machines, identification means are provided comprising two identification pins arranged in a support for the last side by side and shiftable in the direction of identification openings of a strap piece on the last. These identification pins contact, at the ends thereof distant from the last, contact elements of a pick-up or detection unit which is electrically interconnected with a control device for the working devices of the machine. The control device comprises a setting cylinder and a positioning unit coupled therewith, the positioning unit being connected to an electric relay controlling an electromagnetic transfer valve which provides pressure liquid for said setting cylinder, the setting cylinder being coupled to an exchangeable form plate which is provided with a piston anchored on a fixed part of working mechanisms of the shoe stretching means and with a control cylinder controlling the position of a copying or form following roller, this control cylinder being actuated by an electromagnetic transfer valve connected electrically with an electric control relay and with a limit switch.

The detection unit comprises a working cylinder, the piston rod of which is provided with a lever with a stop screw arranged coaxially with the main identification pin and with a yoke connected to a rod slidable parallel with the longitudinal axis of the working cylinder and provided with a toothed rack which meshes constantly with a pinion connected to a carrier, the contact of which when turned coming into contact with individual sections of a fixed, first pick-up commutator. The positioning unit comprises a control pinion connected to a positioning carrier, the contact of which when turned comes into contact with individual sections of a positioning commutator, the individual sections of the positioning commutator being interconnected with corresponding sections of the first pick-up commutator. The control pinion of the positioning unit meshes constantly with a rack connected to the setting cylinder of the form plate for adjustment of the position of working devices of the shoe making machine.

A first end of the auxiliary identification pin differentiates by its axial position between a right or left shoe last. The other end of the auxiliary identification pin, distant from the shoe last, is in contact with a control element of a limit switch connected with control means for the adjustment of working devices for a right or left last.

The improvement obtained by the apparatus according to the invention is primarily that the pick-up or detection unit records by means of an identification pin the size number of the last, and, as it is coupled to a positioning unit, controls the stopping of the flow of pressure liquid to the setting cylinder, the devices controlled thereby are automatically stopped in the required position. An advantage is also that the detection unit comprises a working cylinder which adjusts an identification pin in a blind identification opening and simultaneously turns a contact to a certain section of a first pick-up or detection commutator which is interconnected with the corresponding section of a positioning commutator which is part of a second positioning unit controlling the adjustment of setting cylinders of working devices in a certain position. An auxiliary identification pin is thereby inserted into an auxiliary identification opening in the strap plate of the last, and, as its second end is in contact with a limit switch controlling the mechanism for adjustment of stretching means for a right or left shoe, this adjustment is accomplished simply and automatically.

DESCRIPTION OF THE DRAWINGS

The attached drawings illustrated an examplary embodiment of the apparatus of this invention. In the drawings.

DESCRIPTION OF A PREFERRED EMBODIMENT

Figure 1:
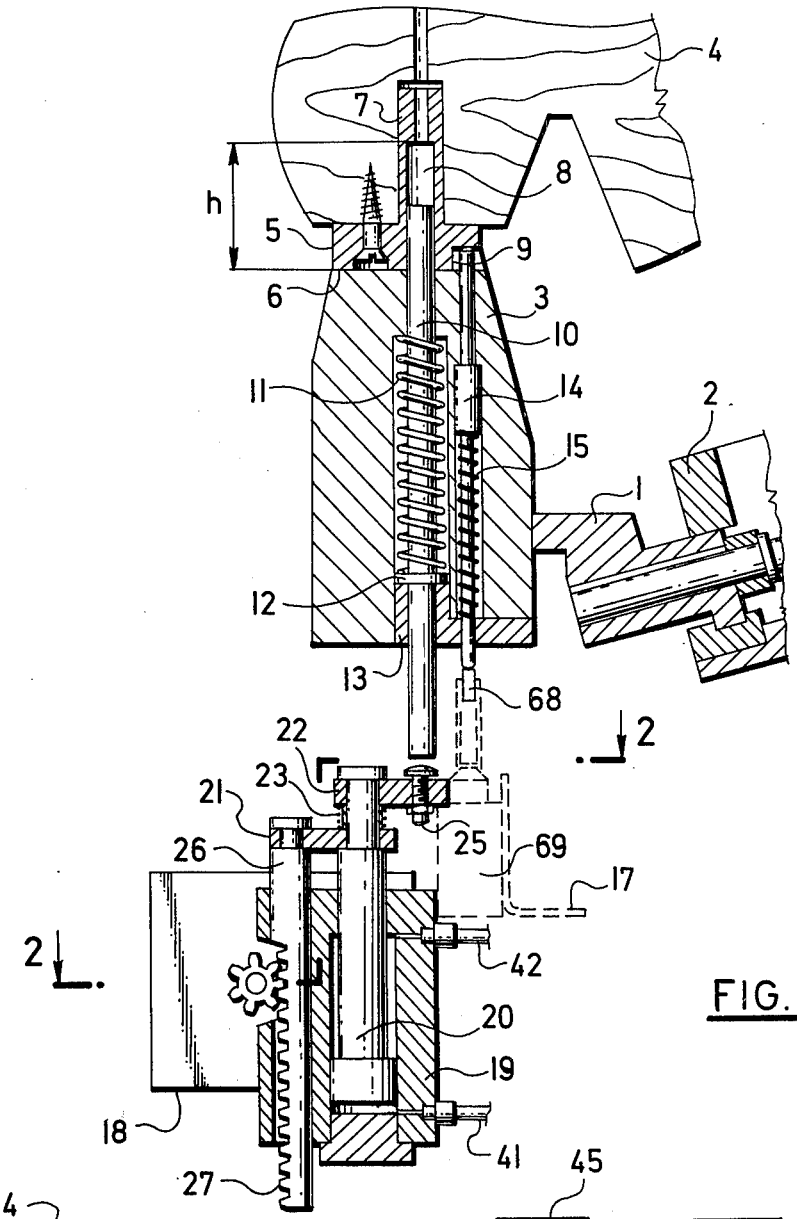
FIG. 1 is a vertical section of the identification means in combination with a shoe last.

Carriers 1 of a shoe line conveyor 2 which moves step-by-step to carry supports 3 of shoe lasts 4 provided with strap plates 5 at the bearing surface of the last 4. The strap plates 5 having a bearing surface 6 are fixed by screws to the last 4 and extend above the bearing surface of the last 4 into a hollow pin 7 with a stepped down identification opening 8, the depth of such opening varying with the shoe size of the last. At the side of the bearing surface 6 an auxiliary identification opening 9 is provided in the strap plate. An identification and centering pin 10 passes through the central part of the support 3, encompassed in its central part by a pressure spring 11, one end of which bears against the bottom of the opening in the support and the other end of which bears against a fixed collar 12 on the identification pin 10. The fixed collar 12 rests against an extension of a cover 13 fixed by screws to the lower part of the support 3. An auxiliary identification pin 14, which differentiates between last for right and left shoes, passes through the support 3 parallel to the identification pin 10, extending equally on both sides beyond the support 3. The auxiliary identification pin 14 has a collar in its central part, against which one end of an auxiliary pressure spring 15 bears, the other end of such spring bearing against the cover 13. The lateral distance between the identification pin 10 and the auxiliary identification pin 14 is equal to the distance between the stepped down identification opening 8 and the auxiliary identification opening 9.

The Size Detecting Pick-up Means

Figure 5:
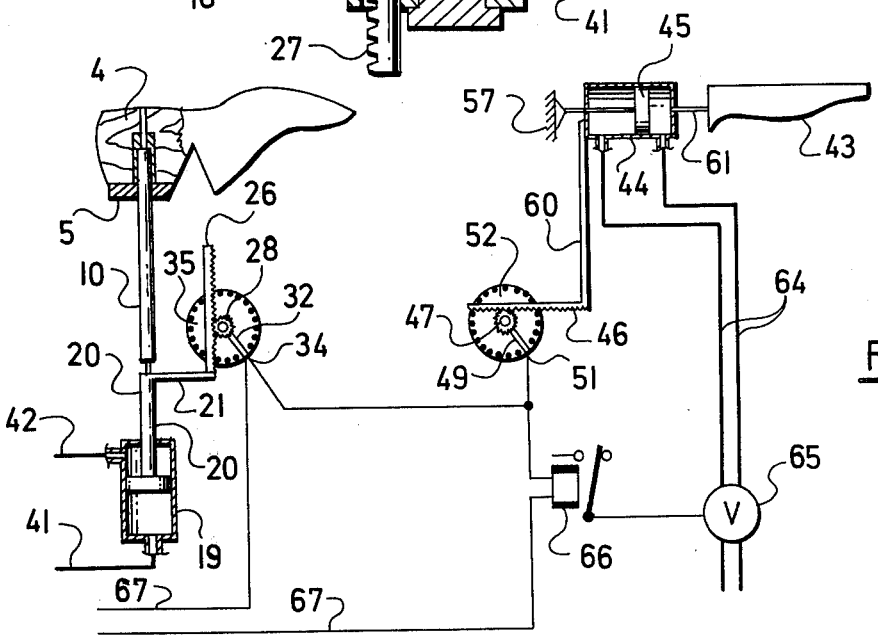
FIG. 5 is an overall diagram of the apparatus as a whole.
Figure 2:
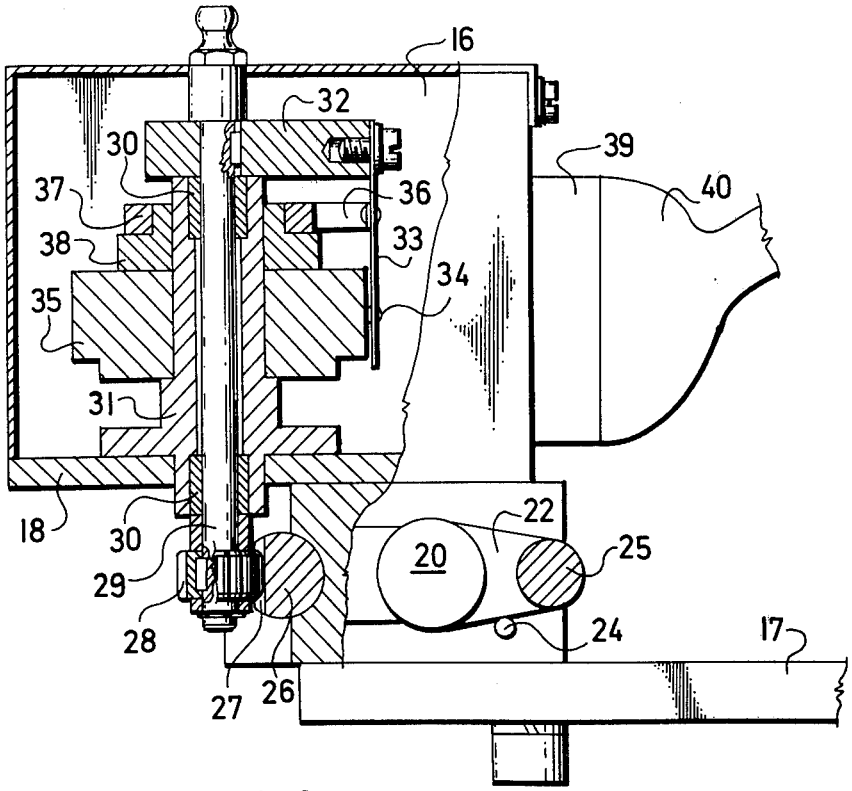
FIG. 2 is a horizontal section of the identification means (section line 2—2)
Figure 4:
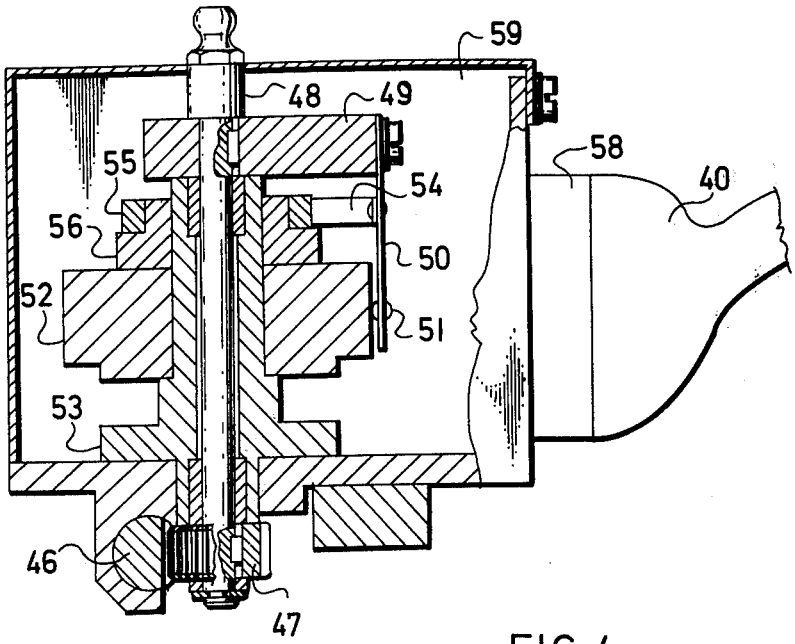
FIG. 4 is a sectional top view of the positioning unit (section line 4—4)

A pick-up means 16 (FIGS. 1 and 2) for detecting the size numbers of both left and right shoe is arranged below both identification pins 10, 14 in the carrier 3 and is fixed, for example, to the frame 17 of the conveyor 2. The pick-up means 16 comprises a supporting case 18 to which a working cylinder 19 is fixed, to the piston rod 20 of which both a yoke 21 and a lever 22 are fixed, which lever 22 is in its normal position urged clockwise (FIG. 2) by a coil torque spring 23 against a fixed pin 24. The lever 22 is thus angularly turnable together with a contact screw 25 supported thereby and provided with a cup head. The yoke 21 is connected to a rod 26 with a rack 27. The rod 26 is parallel with the piston rod 20 and is guided slidingly in an opening in the body of the working cylinder 19. The rack 27 constantly meshes with a pinion 28 keyed on a shaft 29 disposed perpendicularly to the rod 26, and supported in bearings 30 in the hub 31 fixed in the supporting case 18. A carrier 32 made of electrically non-conductive material is keyed on the other end of the shaft 29. An elastic wiper or contact-carrying arm 33 is fixed on the carrier 32 by screws, a contact 34 of the wiper 33 being urged against the circumference of a pick-up commutator 35 affixed to, as by being pressed on the hub 31. An elastic element 36 is fixed to the elastic wiper 33, which is in constant contact with an electrically conductive ring 37 supported on an insert 38 made of electrically non-conductive material on the hub 31. The individual sections of the pick-up commutator 35 are electrically interconnected to a terminal block 39 provided with an electric cable 40. The supply and discharge of pressure liquid to and from opposite ends, respectively, of the working cylinder 19 is secured via a main supply conduit 41 (FIG. 5) and via a discharge conduit 42.

The Setting Of The Form Plate

The mechanism of the shoe stretching machine, for instance a form plate 43 for adjustment of the working means of stretching machines according to size numbers of a right or left shoe, has to be shifted according to the respective size. The form plate 43 is connected both with the setting cylinder 44, the piston 45 of which is anchored by its piston rod on a fixed part 57 of the working device, and in addition is connected with the control rack 46 which meshes constantly with the control pinion 47 keyed on one end of the carrier shaft 48. On the other end of shaft 48 there is keyed a positioning carrier 49 made of electrically non-conductive material. An elastic positioning wiper 50, urged with its contact 51 against the circumference of a positioning commutator 52, which is pressed onto the supporting hub 53, is fixed by screws on the positioning carrier 49. An auxiliary elastic element 54, which is in constant contact with an electrically conductive auxiliary ring 55 fixed by way of an auxiliary insert 56 of electrically non-conductive material on the supporting hub 53, is fixed to the elastic positioning wiper 50.

Figure 3:
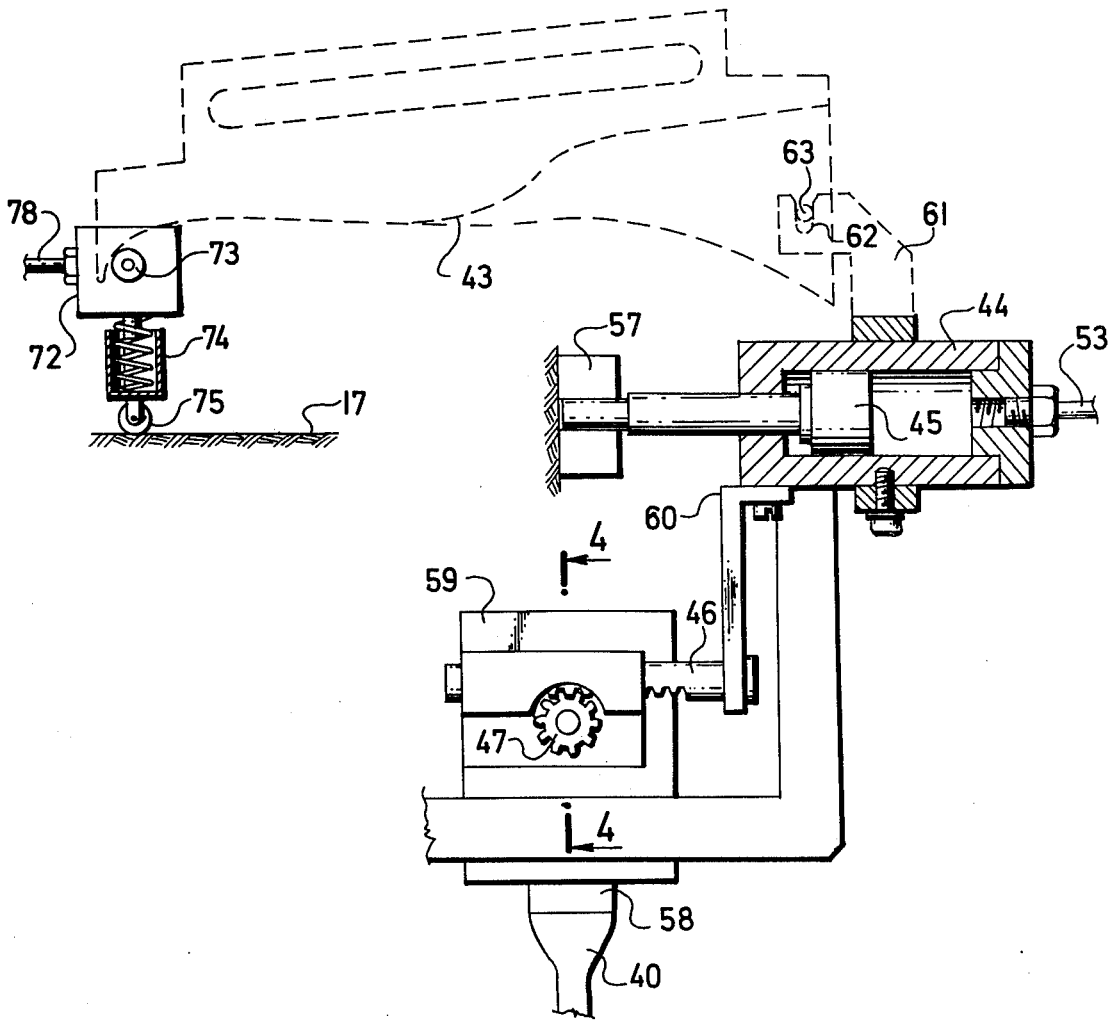
FIG. 3 is a view partially in vertical section and partially in elevation of the control means.
Figure 6:
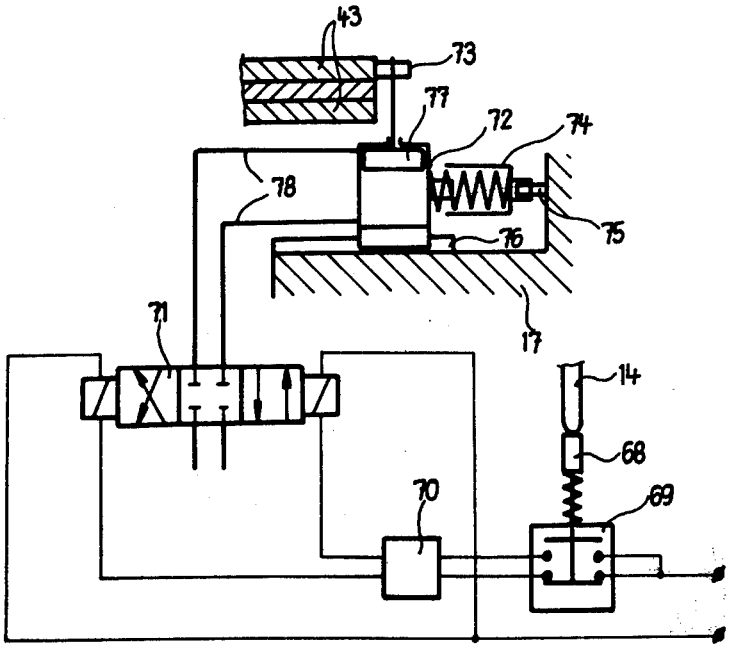

The individual sections of the positioning commutator 52 are electrically interconnected to an auxiliary terminal block 58 and to the electric cable 40 connecting the pick-up commutator 35 with the positioning commutator 52. It will be seen that the described positioning unit 59 is designed in the same way as the pick-up unit 16. The setting cylinder 44 is coupled with the control rack 46 by an auxiliary arm 60 and with the form plate 43 by the carrier arm 61 which is fixed on one end by screws to the setting cylinder 44 and provided on its other end with a slot 62 for a carrier pin 63 fixed to the form plate 43 (FIG. 3).

The pressure liquid is supplied to the setting cylinder 44 via the conduit 64 through an electromagnetic transfer valve 65 controlled by an electric relay 66. Electric current is supplied by one branch line 67 to the pick-up commutator 35 and by a second branch line 67 through the electric relay 66 to the positioning commutator 52, whereby both these commutators 35, 52 are mutually electrically interconnected. A control element 68 of a limit switch 69 is provided (FIG. 1) below the identification pin 14 on frame 17, the limit switch 69 being electrically connected via an electric control relay 70 with an electromagnetic transfer valve 71 controlling the supply and discharge of pressure liquid below or above the piston of a control cylinder 72 (FIG. 3). Pressure liquid is supplied to the control cylinder 72 via supply conduits 78; the control cylinder 72 is supported slidingly in a guide on the frame 17, thus permitting its shifting towards the form plate 43. A copying or form following roller 73 on cylinder 72 is urged against the form plate 43 by a spring loaded element 74 provided with a guiding roller 75 which rests against a flat portion of the frame 17. The form plate 43 has an upper part shaped for a left shoe and a lower part formed for a right shoe. The roller 73, which is mounted upon the piston rod of cylinder 72, according to the position of the piston of the cylinder 72, engages the upper or lower part of the form plate 43 for a left or right shoe, respectively.

The Automatic Adjustment of the Form Plate

The arrangement for the automatic adjustment of form plate 43 operates as follows:

A shoe last 4 centered on the identification pin 10 and fixed on the support 3 by clamping means (not shown) is shifted with the support 3 by the conveyor 2 to the required working position above the fixedly mounted pick-up unit 16. Pressure liquid is supplied via the main conduit 41 below the piston of the working cylinder 19 and the contact screw 25 on the lever 22 urges the identification pin 10 into the stepped down identification opening 8 until it reaches its bottom. The effective depth of the stepped down identification opening 8 in various lasts differs according to whole and half size numbers of the lasts 4. The rod 26 and the rack 27, which constantly meshes with the pinion 28, are simultaneously shifted. Thus the shaft 29 is turned together with the carrier 32 keyed thereon and with the elastic wiper 33 which with its contact 34 passes along the individual sections of the pick-up commutator 35. The supply of electric current is accomplished from ring 37 by the elastic element 36. This identification of size numbers of the last and the transmission of such information to the pick-up unit 16 is carried out during the stretching and ironing operation on a shoe on the conveyor which was treated in the stretching device of the shoe manufacturing machine before the last being considered, the identification taking place in a space beyond this stretching device. During the identification process, the pick-up unit is hydraulically locked in the picked-up position.

Identification of Right and Left Lasts

Simultaneously with the size identification, the auxiliary identification pin 14 determines whether a right or left last should be treated and adjusts the limit switch 69 to the respective position which in turn actuates an electromagnetic valve 71 through a relay which selects a right or left form plate 43 to be actuated. After the stretching operation of the prior treated shoe has been finished, the last 4 with the support 3 is passed to the space of the stretching device of the machine and an impulse is released for the supply of pressure liquid via the conduit 64 through the open electromagnetic transfer valve 65 below the piston 45 of the setting cylinder 44, which starts to be shifted and carries along both the form plate 43 and the control rack 46. Control rack 46 turns the control pinion 47 and the positioning contact 51 along the individual sections of the positioning commutator 52. As soon as the same section of the positioning commutator becomes interconnected with the corresponding section of the pick-up commutator 35, the electric circuit of both branch lines 67 is closed by the electric relay 66, which controls the electromagnetic transfer valve 65 thereby closing the valve. Thus the working device of the shoe stretching machine, in this case the form plate 43, is locked in the required adjusted position.

The adjustment of the copying roller 73 for a right or left shoe is performed by the piston and piston rod of the control cylinder 72, the position of which is determined by an impulse of the limit switch 69 controlled by the auxiliary identification pin 14, the position of which is in turn determined by the auxiliary identification recess 9 in the strap plate 5 of the last 4. The copying roler 73 controls the movement of some working elements, for instance nozzles, for thermoplastic adhesives.

Although the invention is illustrated and described with reference to one preferred embodiment thereof, it is to be expressly understood that it is in no way limited to the disclosure of such a prefereed embodiment, but is capable of numerous modifications within the scope of the appended claims.

What is claimed is:

1. An arrangement for the automatic adjustment of the position of the working devices of shoe stretching devices of a shoe making machine according to the size numbers of right and left shoe lasts, the shoe last having a heel part and a toe part and a bearing surface for fixing it on a support, the last being provided on its bearing surface with a plate, said plate having a hollow extension with a stepped down opening engaging into the heel part of the last, the depth of such opening determining the size number of the last, the plate being provided with an auxiliary opening in addition to the stepped down opening, identification means with an upper and lower face adapted to be moved to different working positions of the shoe making machine a support for the identification means, a support having two longitudinal and parallel openings, a main identification pin slidably arranged within one of the openings and extending beyond both faces of the support, spring means urging the main identification pin into its lower, retracted position, said main identification pin being positioned coaxial with the stepped down opening within the plate of the last, an auxiliary identification pin within the second opening of the support and extending beyond both faces of the support, spring means urging the auxiliary identification pin into its upper position, a detection unit arranged below both identification pins on a fixed part of the machine, the detection unit having a fixed hydraulic working cylinder with a piston arranged slidingly therein, means to raise the main identification pin until it strikes the bottom of the stepped down opening in the extension of the plate, a first detection means comprising means for detecting the position of the raised identification pin and a second detection means for detecting the position of the auxiliary identification pin, and means responsive to the last-named means for selecting a working device for operating upon a right or a left shoe last.

2. An arrangement as claimed in claim 1, wherein the first detection means comprises a working cylinder with a piston and piston rod the axes of which are parallel with the axis of the main identification pin, the working cylinder being fixed on a fixed part of the machine, the piston rod being provided with a lever with a contact screw, the contact screw being situated coaxially with the main identification pin, and the second detection means comprises a yoke connected to the piston rod, a second rod slidably supported in the body of the working cylinder, the yoke being coupled with the second rod, a first rack on the second rod, a fixed first commutator with a number of commutator sections, a first pinion supported coaxially with the first commutator, a first carrier arm with a first wiper connected to the first pinion, the first pinion meshing with said first rack, the first wiper being adapted when turned to contact individual sections of the first commutator.

3. An arrangement as claimed in claim 2, comprising a unit for positioning the working device, said positioning unit comprising a fixed commutator with a number of commutator sections corresponding to the number of sections of the first commutator, a hydraulic setting cylinder, means for adjusting working devices of the shoe making machine actuated by the setting cylinder, a second rack actuated by the setting cylinder, a rotatable second pinion supported coaxially with the axis of the second commutator, a second carrier arm with a second wiper connected to the second pinion, the second rack meshing with said second pinion, the second wiper being adapted when turned to contact individual sections of the second commutator.

4. An arrangement as in claim 3, comprising means electrically interconnected corresponding sections of the first and second commutators.

5. An arrangement as in claim 4, comprising an electromagnetically controlled hydraulic valve supplying pressure liquid to the setting cylinder, an electric relay connected in an electric circuit connecting corresponding sections of both commutators and adapted to stop the supply of pressure liquid to the setting cylinder and thus to lock the means for adjusting the working devices of the shoe making machine in the required position.

* * * * *